United States Patent [19]

Shen

[11] Patent Number: 4,949,659

[45] Date of Patent: Aug. 21, 1990

[54] CONTAINER/BULK CARGO INTERCHANGEABLE SYSTEM

[76] Inventor: Michael M. Shen, 5214 Mornington Ct., Fairfax, Va. 22032

[21] Appl. No.: 432,990

[22] Filed: Nov. 7, 1989

[51] Int. Cl.[5] ..... B63B 25/00

[52] U.S. Cl. ..... 114/78; 114/72; 114/75; 114/78

[58] Field of Search ..... 114/72, 73, 75, 76, 114/77 A, 77 R, 78, 85, 259, 26 D

[56] References Cited

U.S. PATENT DOCUMENTS

| | | | |
|---|---|---|---|
| 2,736,287 | 2/1956 | Kummerman | 114/72 |
| 2,923,265 | 2/1960 | Pontoni | 114/73 |
| 3,087,453 | 4/1963 | Friedman | 114/72 |
| 3,109,402 | 11/1963 | Blumberg | 114/72 |
| 3,440,990 | 4/1969 | Van Riet | 114/73 |
| 3,616,776 | 11/1971 | Anker-Nilsen | 114/76 |
| 3,709,181 | 1/1973 | Papanicolaou | 114/72 |

*Primary Examiner*—Joseph F. Peters, Jr.
*Assistant Examiner*—Clifford T. Bartz
*Attorney, Agent, or Firm*—Walter F. Wessendorf, Jr.

[57] ABSTRACT

A container/bulk cargo interchangeable system to allow a cargo ship's hold the versatility and option of storing and carrying either ISO containers entirely, or of storing and carrying bulk cargo or break bulk entirely, or of storing and carrying a combination of ISO containers and bulk cargo or break bulk. Sets of two flat platforms may be raised to their vertical upright positions to permit the entire storage of ISO containers; or the sets of flat platforms may be lowered to their horizontal dispositions for the entire storage thereon of bulk cargo or break bulk; or the requisite number of sets of flat platforms may be raised to their vertical upright positions and the remaining sets of flat platforms may be lowered to their horizontal dispositions for storage of ISO containers and bulk cargo or break bulk, respectively.

2 Claims, 1 Drawing Sheet

CONTAINER/BULK CARGO INTERCHANGEABLE SYSTEM

BACKGROUND OF THE INVENTION

1. Technical Field

This invention relates to a container/bulk cargo interchangeable system that affords a cargo ship the versatility and option of either entirely storing containers in its cargo compartments; or storing a combination, or mixed cargo, of containers and bulk cargo in its cargo compartments; or in entirely storing bulk cargo in its cargo compartments.

2. Background

In accordance with the International Standard Organization (ISO), a standard ISO container is 8'×8'×40'. Bulk cargo or break bulk is cargo that is dimensionally too large to be carried in such ISO container. A cargo ship may be equipped to carry only ISO containers and thereby is unable to carry bulk cargo or break bulk. A cargo ship, carrying ISO containers, must dock at a port of destination that has crane facilities for removing such standard ISO containers. If such cargo ship, upon reaching its port of destination, is unable to pick up another load of ISO containers for transport to another port having crane facilities or for return to its home port, such ill-fated cargo ship must waste expensive idle time in its port of destination, awaiting another full load of standard ISO containers. However, such cargo ship, upon reaching its port of destination, may be able to pick up a full load of mixed ISO containers and bulk cargo or break bulk, or a full load of strictly bulk cargo or break bulk, but unfortunately is unable to do so because it is not equipped to carry a combination load of standard ISO containers and bulk cargo or break bulk, or a load of strictly bulk cargo or break bulk.

SUMMARY OF THE INVENTION

To contribute to the solution of this discussed problem of the prior art, the system of this invention allows and affords a cargo ship the versatility of carrying either a full load of standard ISO containers, a combination load of standard ISO containers and bulk cargo or break bulk, or a load of bulk cargo or break bulk.

BRIEF DESCRIPTION OF THE DRAWINGS

This object and other objects of the invention should be discerned and appreciated from the description of the preferred embodiment taken in conjunction with the drawings, wherein like reference numerals refer to similar parts throughout the several drawing figures, in which: in which.

DESCRIPTION OF THE PREFERRED EMBODIMENT

Figure 1:
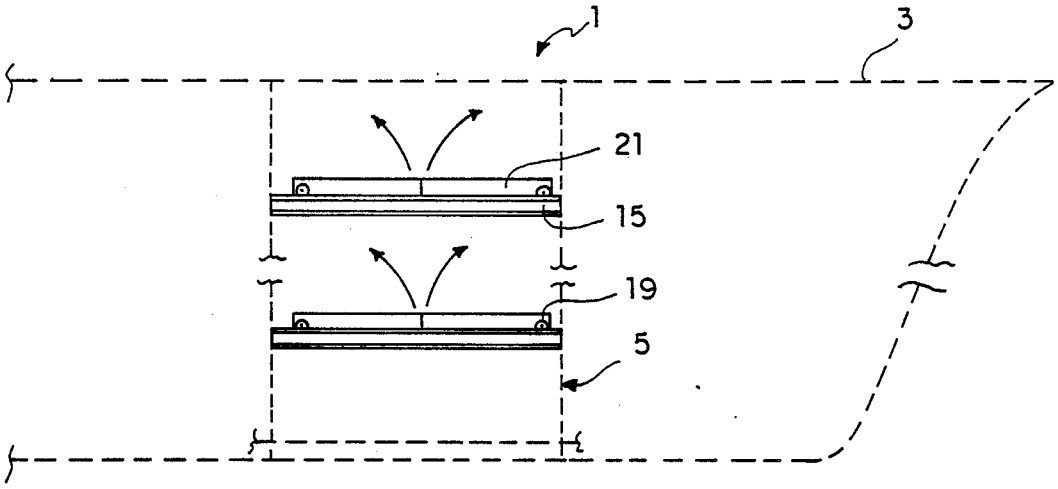
FIG. 1 is a side elevational view of a cargo ship structurally employing the system of this invention.
Figure 2:
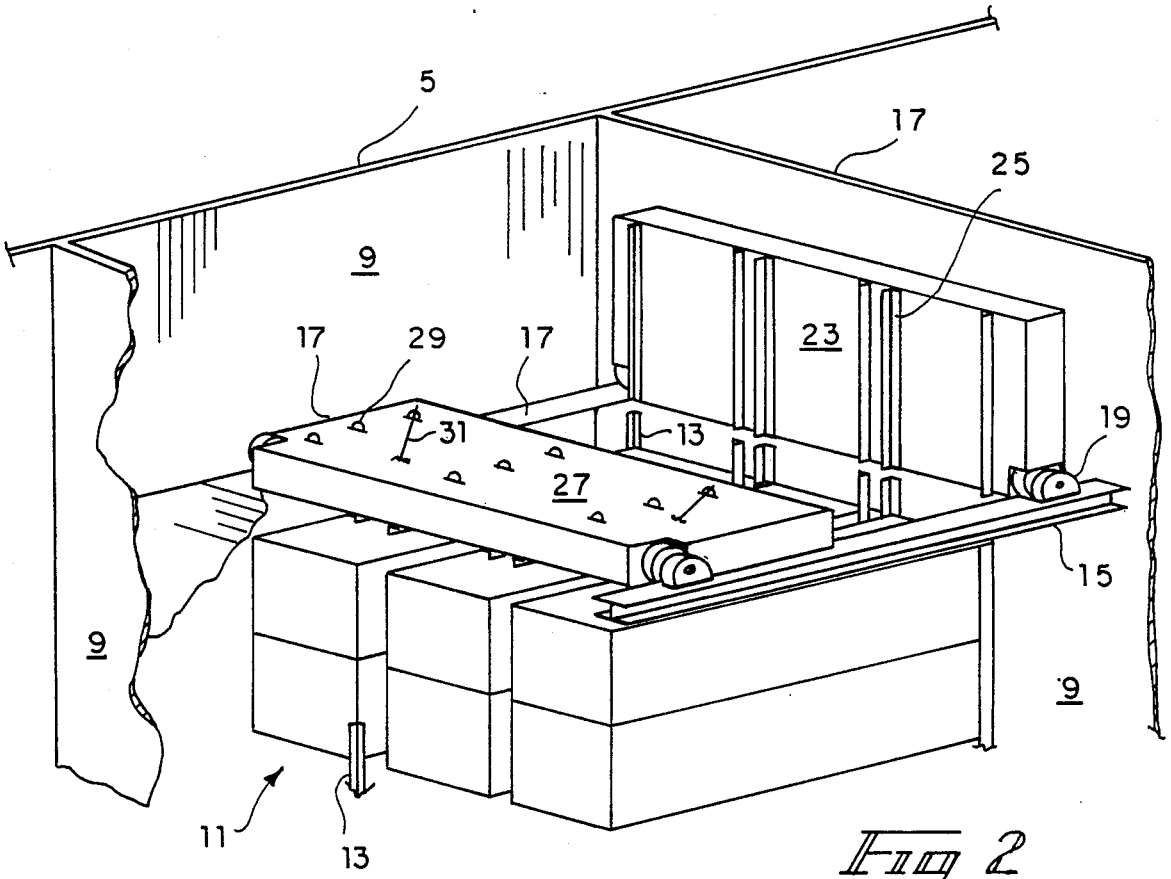
FIG. 2 is a perspective view of a portion of a cargo ship's compartment employing the system of this invention.

In FIG. 1 of the drawings, reference numeral 1 generally refers to the invention. A cargo ship 3 has a number of holds 5, depending, of course, upon the size of the ship 3 and the number of ISO containers it stores and carries. Hold 5 has vertical side walls 5 defining a compartment 11 for storing and carrying ISO containers 7. The vertical side walls 9 fixedly carry vertical cell guides 13 to receive therebetween the stacked ISO containers 7. The vertical side walls 9 fixedly carry therebetween, in horizontal disposition, I-beam platform support structure 15 and laterally extending platform support structure 17. The support structures 15 and 17 are in coplanar relationship. Pintle hinges 19, fixedly carried by the support structures 15 and 17, and the flat platforms 21, allow the flat platforms 21 to be pivotally articulated and raised or lowered. The bottom surfaces 23 of the platforms 21 fixedly carry cell guides 25. Upon the flat platforms 21 being raised to their upright vertical positions, the cell guides 25 are in alignment with the cell guides 13 carried by the vertical side walls 9. The top surfaces 27 of the flat platforms 21 fixedly carry D-rings 29 mounting winch cables 31. The winch cables 31 are operatively connected to conventional winches (not shown), operable in one direction to raise the platforms 21 to their vertical upright positions and operable in the opposite direction to lower, by force of gravitY, the platforms 21 to their horizontal positions with the platforms 21 resting upon the support structures 15 and 17. In the horizontal disposition of a set of two platforms 21, such two platforms 21 are in coplanar relationship. The remaining D-rings 29 on the platforms 21 are utilized to lash down bulk cargo or break bulk.

OPERATIONAL DESCRIPTION

Preparatory to the cargo ship 3 being employed to entirely store and carry ISO containers 7, all the flat platforms 21 are appropriately raised to their vertical upright positions. When the cargo ship 3 is employed to entirely store and carry bulk cargo or break bulk, the flat platforms 21 are appropriately lowered in consecutive order to their horizontal positions and the bulk cargo or break bulk is appropriately lashed down to the D-rings 29. When the cargo ship 3 is employed to store and carry a combination or mixed cargo of ISO containers 7 and bulk cargo or break bulk, the requisite number of sets of platforms 21 are raised to their vertical upright positions to spatially accommodate the ISO containers 7 and the remaining sets of platforms 21 are appropriately lowered to rest in horizontal disposition on the support structures 15 and 17 to store and carry the bulk cargo or break bulk.

I claim:

1. In a cargo ship's cargo hold, a container/bulk cargo interchangeable system affording such ship the versatility and option of entirely storing and carrying International Standard Organizational (ISO) standard containers, or of storing and carrying a combination of ISO containers and bulk cargo or break bulk, or of entirely storing and carrying bulk cargo or break bulk; said system comprising hold side walls, horizontal support structure, a plurality of flat platforms, hinges, winching cables and cell guides; said hold side walls fixedly carrying said support structure, said support structure and flat platforms fixedly carrying said hinges, said platforms carrying said winching cables, said winching cables being operable in one direction to raise said platforms to vertical upright positions to permit the storage and carrying of said ISO standard containers, and in an opposite direction to lower, by force of gravity, and dispose said platforms in horizontal rest upon said support structure to store and carry bulk cargo or break bulk, and a requisite number of said platforms being raised to their vertical upright positions and the remainder of said platforms being lowered to their horizontal positions to thereby store and carry said ISO containers and to store and carry said bulk cargo or break bulk, respectively, said flat platforms having bottom surfaces, both said bottom surfaces of said flat platforms and said hold side walls fixedly carrying thereon said cell guides, said hold side walls fixedly carrying said cell guides in vertical disposition, said cell guides on said bottom surfaces of said flat platforms and on said hold side walls receiving therebetween said ISO containers, and said cell guides on said bottom surfaces of said flat platforms in their vertical upright positions of said flat platforms being in common alignment with said cell guides on said hold side walls.

2. A container/bulk cargo interchangeable system in accordance with claim 1, wherein said flat platforms are arranged and disposed in sets of two platforms each, and wherein, when a set of two of said platforms is lowered in horizontal rest upon said support structure, said two platforms of said set are in coplanar relationship.

* * * * *